United States Patent [19]

Simon

[11] Patent Number: 4,880,119

[45] Date of Patent: Nov. 14, 1989

[54] CUSHIONED CONTAINER FOR HAZARDOUS MATERIAL

[76] Inventor: B. Kenneth Simon, 40 Woodhaven Dr., Pittsburgh, Pa. 15228

[21] Appl. No.: 210,865

[22] Filed: Jun. 24, 1988

Related U.S. Application Data

[63] Continuation of Ser. No. 34,547, Apr. 6, 1987, abandoned.

[51] Int. Cl.[4] ..... B65D 81/14; B65D 85/84

[52] U.S. Cl. ..... 206/584; 215/13.1

[58] Field of Search ..... 215/13.1; 206/521, 584

[56] References Cited

U.S. PATENT DOCUMENTS

| | | | |
|---|---|---|---|
| 301,250 | 7/1984 | Long . | |
| 950,093 | 2/1910 | Cox | 215/13.1 |
| 1,601,547 | 9/1926 | Wofford . | |
| 2,579,036 | 12/1951 | Edelman | 154/44 |
| 2,780,350 | 2/1957 | Simon et al. | 215/13.1 X |
| 2,868,428 | 1/1959 | Bergstrom | 229/14 |
| 2,881,936 | 4/1959 | Piken | 215/13.1 |
| 2,979,246 | 4/1961 | Liebeskind | 229/14 |
| 3,074,543 | 1/1963 | Stanley | 206/46 |
| 3,241,209 | 3/1966 | Taylor | 215/13.1 |
| 3,256,441 | 6/1966 | Grasty | 250/108 |
| 3,432,666 | 3/1969 | Nash et al. | 250/108 |
| 3,435,946 | 4/1969 | Sobek et al. | 206/46 |
| 3,500,996 | 3/1970 | Gorman | 206/46 |
| 3,531,644 | 9/1970 | Koster | 250/106 |
| 3,882,315 | 5/1975 | Soldan | 250/506 |
| 3,999,653 | 12/1976 | Haigh et al. | 206/584 |
| 4,020,355 | 4/1977 | Czaplinski et al. | 250/506 |
| 4,081,688 | 3/1978 | Fries | 250/506 |
| 4,190,160 | 2/1980 | Andersen et al. . | |
| 4,560,069 | 12/1985 | Simon | 206/591 |
| 4,573,578 | 3/1986 | Greminger, Jr. et al. . | |

FOREIGN PATENT DOCUMENTS

| | | | |
|---|---|---|---|
| 113656 | 2/1918 | United Kingdom | 229/91 |

*Primary Examiner*—William Price
*Attorney, Agent, or Firm*—Buchanan Ingersoll

[57] ABSTRACT

A container assembly for transporting hazardous or corrosive material wherein a bottle containing the material is cushioned against breakage and the container is protected against leakage. The assembly includes an outer metal container with a bottle disposed within but partially or entirely out of contact with the container. The bottle is separated from the container by a plurality of separate, removable and repeatedly moldable and shapable cushion elements. Each cushion element is filled with a free flowing particulate solid material. There are individual cushion elements below the bottle, above the bottle and wrapped around the body portion of the bottle, respectively. Thereby, the cushion elements can fill essentially the entire space between the bottle and the metal container, providing mechanical support and absorption capability in case of leakage or breakage. The cushion elements can be quilted to provide pockets which prevent uneven distribution of the absorbent material.

11 Claims, 3 Drawing Sheets

CUSHIONED CONTAINER FOR HAZARDOUS MATERIAL

This application is a continuation of my copending application Ser. No. 034,547 filed Apr. 6, 1987 and now abandoned.

This invention relates to a cushioned container assembly for storing and transporting any material, particularly hazardous or corrosive liquid or solid material. The hazardous material is contained in a glass, plastic or metal bottle having a closure cap. One type of bottle has a relatively wide cylindrical body portion and a relatively narrow neck. The bottle opening is at the top of the neck and is enclosed by means of a closure cap. A shoulder on the bottle separates the body portion from the neck of the bottle. If desired, the bottle can be uniformly cylindrical over its entire extent, in which case it will not have a shoulder. The bottle need not be cylindrical but can be square or oblong.

The bottle is disposed within a metal container having a bottom and a frictionally engaged metal cover. The wall of the container can be cylindrical, square or oblong. The bottle is maintained partially or entirely out of contact with both the metal container and the cover by means of a plurality of individual, separate and removable cushion elements filled with a free flowing particulate solid material. Each of the cushion elements can be repeatably moldable and shapable by the user while maintaining structural integrity. The cushion elements are tightly wedged between some or all portions of the bottle and the interior of the metal container. The cushion elements are mutually separate and independent and do not require attachment to each other or to the metal container or to the bottle. Each cushion element can comprise a double layer of fabric which is sewn along the edges to enclose the free flowing particulate solid material which is a cushioning material and which can also be an absorbent for the hazardous material in the bottle when the hazardous material is a liquid. The fabric is chemically resistant to the hazardous material and will not dissolve therein. The absorbent will retain any hazardous material leaking from closure cap due to loosening of the cap during transport or leaking from a crack in the bottle. There can be a sufficient amount of absorbent present to absorb all of the hazardous material if the bottle should break during transport or handling or if the closure cap should become disengaged.

At least two cushion elements are employed. Preferably, three or more cushion elements are employed, including a disc- or square-shaped cushion element at the bottom of the bottle, a disc- or square-shaped cushion element at the top of the bottle and a generally rectangular wrap-around blanket cushion element for the body of the bottle. The cushioning material can be any suitable free flowing particulate material, such as vermiculite. Because the wrap-around cushion is disposed vertically, it is advantageously sewn into quilted compartments or pockets with horizontally extending stitches and possibly also with vertically extending stitches, to maintain the particulate material relatively evenly distributed along the entire extent of the wrap-around cushion. If desired, the top and bottom cushions can also be quilted, although the need for quilting therein will not be as stringent because the top and bottom cushions are each horizontally disposed and the tendency of the absorbent to flow is thereby reduced.

Quilting transforms each cushion element from a highly flexible state to a semi-rigid state. Excessive quilting should be avoided so that each element does not become so rigid that it cannot flex sufficiently to conform with the bottle surfaces which it is desired to surround and support. However, quilting to an extent that provides semi-rigidity will retain bendability, moldability and shapability, allowing the cushion elements to conform with bottle surfaces while providing high mechanical strength in the cushions and good particulate packing.

If the bottle has a shoulder, the edges of the top cushion element can be indented or bent downwardly from the closure cap of the bottle to the shoulder in order to fill the space between the wrap-around blanket and the neck of the bottle. The wrap-around blanket can thereby surround the top cushion element. In this manner, the cushion elements can substantially fill the entire space between the bottle and the metal container to provide maximum absorption capability and to provide protection for the bottle against mechanical shock. Furthermore, the downward indenting of the cushion provides maximum protection for the closure cap of the bottle, which is the region most susceptible to leakage by entirely surrounding the cap with absorbent material.

The fibers comprising the corrosion resistant fabric for the cushion elements are woven net-like into a mesh whose openings are sufficiently small to retain the particulate material but which will allow corrosive liquid to enter the interior of the cushion elements to be absorbed by the absorbent.

The assembly is adapted to provide storage capability for bottles of various sizes within a particular metal container. For example, small bottles can be protected by providing more than one top cushion or more than one bottom cushion. Also, more than one wrap-around cushion can be employed or a single wrap-around cushion can wrap around a relatively small bottle more than one time.

This invention will be more completely understood by reference to the accompanying figures in which.

Figure 1:
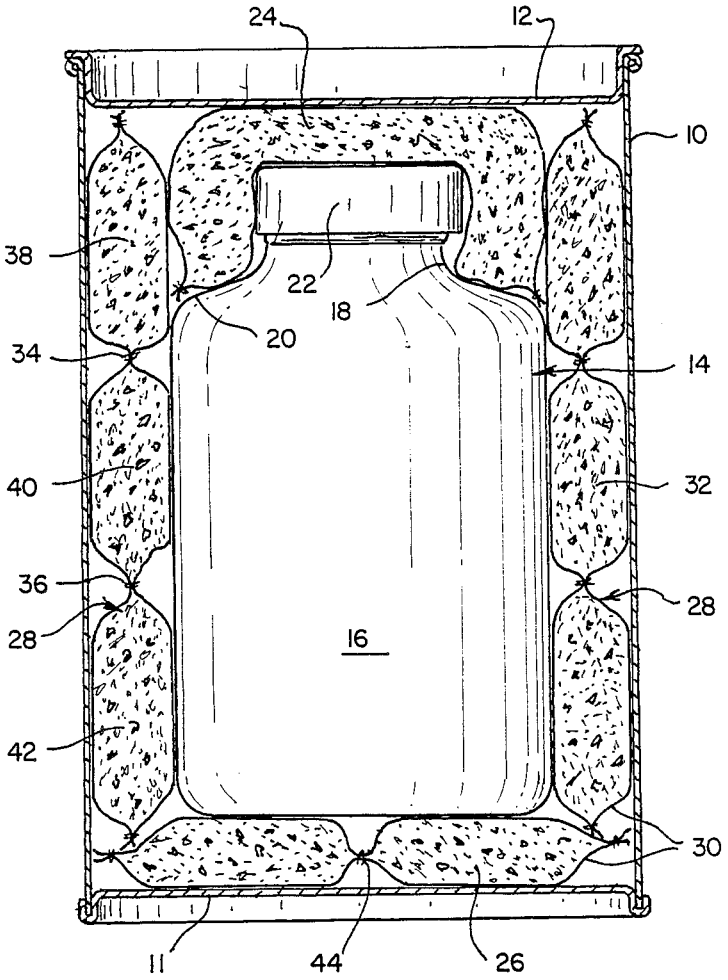
FIG. 1 shows a cross-sectional view of a container assembly of the invention.

Referring to FIG. 1, cylindrical metal container 10 having a bottom 11 is closed with a tightly secured metal cover 12. Bottle 14 contains a hazardous or corrosive liquid and is disposed within container 10 and is out of contact with cylindrical container 10, bottom 11 and cover 12. Bottle 14 can comprise glass, plastic or metal. A commonly used bottle includes a relatively wide cylindrical body portion 16 and a relatively narrow cylindrical neck portion 18 to define a shoulder 20 therebetween. The opening of the bottle is at the top of neck portion 18. Plastic closure cap 22 is tightly screwed onto neck 18 by means of mating threads on neck 18 and cap 22, not shown.

Bottle 14 is maintained out of contact with metal container 10 including bottom 11 and metal cover 12 by means of at least three individual, separate and unconnected cushion elements, including top cushion element 24, bottom cushion element 26, and wrap-around intermediate and blanket-like cushion element 28. The thickness of the cushion elements is established so that the elements fit snugly between bottle 14 and container 10, bottom 11 and cover 12 to essentially fill the space therebetween and to tightly secure the bottle in a non-movable position. Each cushion element can comprise an outside fabric 30 arranged as two overlying fabric layers or sheets sewn together along their edges and having a space between the layers. The space between the layers is filled with a free flowing particulate cushioning material 32 which can also be absorbent, such as vermiculite. The individual fibers comprising fabric 30 are woven to define net-like mesh openings which are sufficiently small to retain particles 32, while allowing any leakage of liquid from bottle 14 to reach particles 32 and become absorbed by said particles. Fabric 30 comprises a material, such as nylon, which is chemically inert or chemically resistant to the liquid within bottle 14 and will not be dissolved if leakage should occur. Thereby, particles 32 will not be released from the cushion interior upon leakage of corrosive material from bottle 14.

Figure 3:
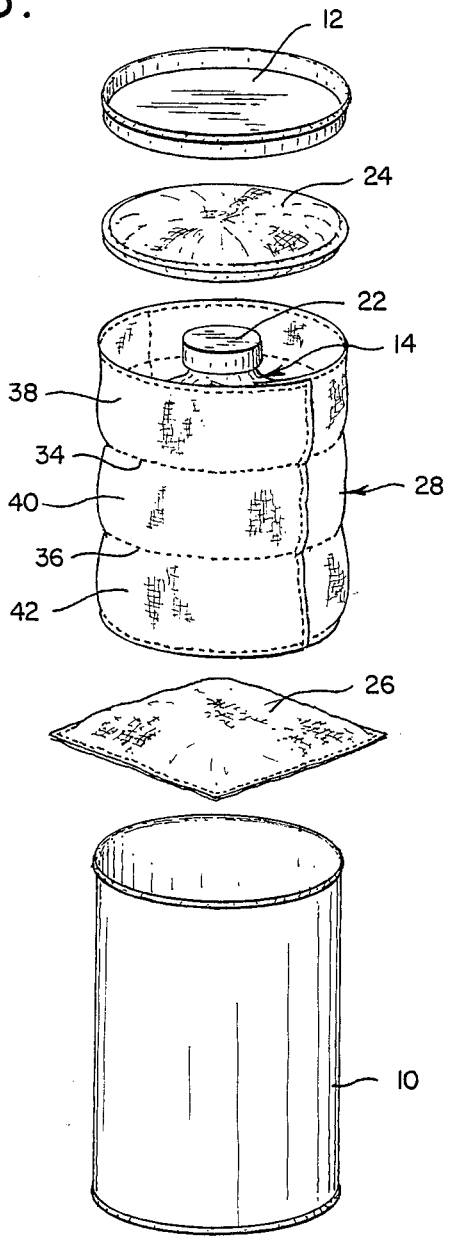
FIG. 3 shows an exploded view of a container assembly.

Top cushion element 24 and bottom cushion element 26 can be of any suitable shape to fit snugly within the cross-section of container 10. For example, FIG. 3 shows a disc-shaped top cushion element 24 and a square-shaped bottom cushion element 26. Either or both of the elements 24 and 26 can be disc-shaped and either or both can be square shaped, or the elements can be oblong, and the elements 24 and 26 can be interchanged. If elements 24 and 26 do not fill all the available space, two or more top elements or two or more bottom elements, or both, can be employed so that essentially all available space is filled and so that bottle 14 is secured against movement.

Cushion elements 24, 26 and 28 can be quilted by sewing to create pockets or compartments within the elements as required to retain a uniform distribution of particles 32 and provide a semi-rigid cushion structure. These compartments obstruct flow of what is otherwise free-flowing particulate matter 32 to prevent accumulation of the particles in any region of the cushion elements and coincident bulging of the cushion in said region. Such bulging would distort the shape of the cushion elements, inhibit bendability and inhibit fit of the cushion elements in the space between bottle 14, cylindrical container 10, bottom 11 and cover 12. Coincidently, other regions of the elements would be proportionally devoid of absorbent material.

Quilting is particularly important in wrap-around blanket element 28 because element 28 is disposed in a vertical rather than a horizontal position. In the absence of quilting in wrap-around blanket 28 vertical positioning would allow particulate matter 32 to easily flow from the top to the bottom of the element, inducing bulging at in the bottom region of wrap-around cushion 28 and preventing proper fit between bottle 14 and metal container 10. Therefore, wrap-around cushion 28 is quilted by sewing horizontal seams 34 and 36 to form three separate compartments 38, 40 and 42 in the embodiment shown. If required, more or less horizontal seams can be sewn and one or more vertical seams, not shown, also can be employed. The number of seams should not be so great that the seams consume excessive space otherwise available for particulate material or so that the blanket becomes excessively rigid and unbendable. FIG. 1 shows that seams 34 and 36 are indented or recessed as compared to the outermost lateral protrusion of cushion 28 so that seams 34 and 36 are out of contact with metal container 10. Similarly, if bottom cushion 26 is quilted, as shown at seam 44 in FIG. 1, seam 44 is indented or recessed and is out of contact with metal container bottom 11. Thereby, the continuous surface regions of the cushion fabric, rather than the seams, protrude and are available to accept mechanical shock. This provides a wider distribution of mechanical shock throughout the cushion elements than would be possible if the seams protruded and accepted mechanical shock.

Quilting restricts flow of otherwise free flowing particulate material 32. Quilting provides pockets to retain even distribution of particulate matter. As stated above, with the addition of horizontal and vertical quilting seams, blanket 28 becomes increasingly rigid. The number of horizontal and vertical quilting seams is selected to provide optimum rigidity, i.e., too few seams will not accomplish uniform distribution of particulate matter so that gathering and bunching of particulates will occur while too many seams will induce too much rigidty for adequate wrapability of the cushion. Therefore, the number and spacing of the quilting seams should be such that a semi-rigid condition is imparted with adequate flexibility at the seams and between the seams to enable rolling of blanket 28 into a cylindrical configuration which is snug with respect to body 16 of bottle 14 and which fits into container 10.

FIG. 1 shows that the ends of upper cushion 24 are conveniently downturned onto shoulder 20 of bottle 14 so that the edges of cushion 24 rest upon shoulder 20. This provides both absorption and load distribution advantages. The absorption advantage is provided because the cushion elements are arranged to fill substantially the entire space between bottle 14 and both container 10 and cover 12. Thereby, if a crack should occur at any portion of bottle 14, absorbent material will be available to absorb leaking liquid. Any leakage of hazardous or corrosive liquid from the vicinity of cap 22, such as can occur if vibration causes a loosening of cap 22 on bottle 14, is readily absorbed by the downturned ends of top cushion 24. The load distributing advantage is achieved if container 10 should be dropped on cover 12. In such case, the mechanical load is transferred through metal cover 12 and top cushion 24 to both cap 22 and shoulder 20. Because shoulder 20 can accept a portion of the mechanical load, the load on cap 22 is diminished and the likelihood of a leak developing at cap 22 is thereby reduced.

The employment of a plurality of separate and unattached cushions in accordance with this invention permits the accommodation of a variety of sizes of bottles and containers. For example, if a relatively squat bottle is to be handled as compared to bottle 14, more than one top cushion 24 and or more than one bottom cushion 26, or both, can be employed to tightly secure the squat bottle within container 20. Similarly, if a relatively more narrow bottle is to handled, more than one wrap-around blanket 28 can be employed or, alternately, a single wrap-around blanket which is sufficiently wide to be wrapped or rolled around the narrow bottle more than once can be employed.

Figure 2:
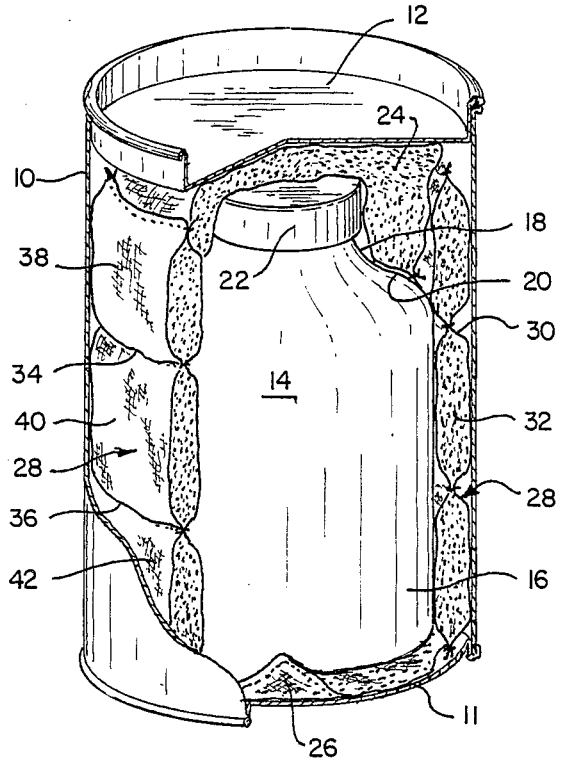
FIG. 2 shows a cutaway isometric view of a container assembly.

FIGS. 1 and 2 show that the three element cushion assembly provides no degree of freedom for movement of bottle 14 in container 10 and retains bottle 14 in an upright position and protects against tilting of bottle 14. Thereby, maximum mechanical protection is provided to bottle 14.

It is apparent from FIG. 3 that the assembly is easily disassembled. First, lid 12 is removed, followed by the removal of upper cushion 24. Thereupon, bottle 14 can be grasped in the region of closure cap 22 and lifted vertically out of wrap-around blanket 28. Thereby, no ties or other fasteners are required for the absorbent or cushion system of this invention.

It is further apparent from the figures that the three piece cushion assembly allows each cushion element to itself abut tightly against bottle 14 without interferring with the tightness of fit of any other cushion element. For example, wrap-around blanket 28 is urged against bottle 14 when it is rolled around the bottle without interfering with the top or bottom elements. Also, top and bottom cushion elements 24 and 26, respectively, are urged against the adjoining portions of the bottle without interfering with each other or with the wrap-around element. Furthermore, all seams are recessed and do not interfere with contact between the cushion elements and the container or the bottle.

I claim:

1. In combination, a metal container, a bottle for containing a hazardous material disposed within said container, said bottle having a body and a closure cap, a plurality of separate, unattached, removable and repeatably moldable and shapable cushion elements adaptable to conform with bottle surfaces and to accommodate a variety of sizes of bottles and containers, said cushion elements disposed between said bottle and said container, said cushion elements being filled with free flowing particulate solid absorbent material, said cushion elements containing sufficient absorbent material to absorb essentially all of the hazardous material in the bottle, said cushion elements arranged to fit snugly between the bottle and the metal container with said cushion elements filling essentially the entire space between the bottle and the metal container to tightly secure the bottle in a non-movable position.

2. The combination of claim 1 including a first cushion element wrapped around the body of the bottle, a second cushion element disposed above the bottle and a third cushion element disposed below the bottle.

3. The combination of claim 2 wherein at least one of said second and third elements is square shaped.

4. The combination of claim 2 wherein at least one of said second and third elements is disc shaped.

5. The combination of claim 2 including at least one additional cushion element disposed below said third element.

6. The combination of claim 2 including at least one additional cushion element disposed above said second element.

7. The combination of claim 2 wherein said first cushion element is wrapped around said bottle once.

8. The combination of claim 2 wherein said first cushion element is wrapped around said bottle more than once.

9. The combination of claim 2 wherein said first cushion element is quilted to maintain relatively uniform distribution of said particulate material throughout said first element.

10. The combination of claim 1 wherein said particulate material is vermiculite.

11. The combination of claim 1 wherein said cushion elements comprise a double layer corrosion resistant fabric filled with particulate absorbent material.

* * * * *

UNITED STATES PATENT AND TRADEMARK OFFICE

CERTIFICATE OF CORRECTION

PATENT NO. : 4,880,119

DATED : November 14, 1989

INVENTOR(S) : B. KENNETH SIMON

It is certified that error appears in the above-identified patent and that said Letters Patent is hereby corrected as shown below:

On the title page:

At [56], References Cited, change "7/1984" to --7/1884-- in Long, 301,250.

Signed and Sealed this

Sixth Day of November, 1990

*Attest:*

HARRY F. MANBECK, JR.

*Attesting Officer*

*Commissioner of Patents and Trademarks*